United States Patent [19]

Holliday

[11] 4,042,988

[45] Aug. 23, 1977

[54] AIR MATTRESS

[76] Inventor: Odell Holliday, 415 Washington Ave., Brooklyn, N.Y. 11238

[21] Appl. No.: 738,246

[22] Filed: Nov. 2, 1976

[51] Int. Cl.[2] ..... A47C 27/08

[52] U.S. Cl. ..... 5/349; 5/365; 5/368

[58] Field of Search ..... 5/341, 91, 338, 355, 5/361 R, 361 B, 368, 365

[56] References Cited

U.S. PATENT DOCUMENTS

| | | | |
|---|---|---|---|
| 2,069,422 | 2/1937 | Sampson | 5/349 |
| 2,192,601 | 3/1940 | Mattison | 5/355 |
| 2,345,421 | 3/1944 | Perry | 5/349 |
| 2,748,399 | 6/1956 | Rockoff | 5/349 |

*Primary Examiner*—Peter M. Caun

*Attorney, Agent, or Firm*—Allen D. Brufsky

[57] ABSTRACT

An air mattress construction comprises a hollow mattress enclosure which is releasably opened and closed at the top thereof by a zipper. A resilient support member is insertable in the mattress enclosure and has an upper surface having a plurality of elongated widthwise grooves therein. Each groove receives an elongated inflatable air tube which is releasably retained therein.

8 Claims, 5 Drawing Figures

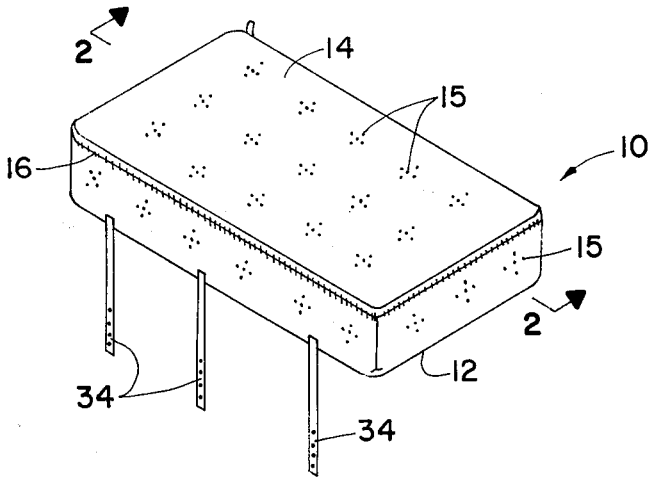
FIG. 1
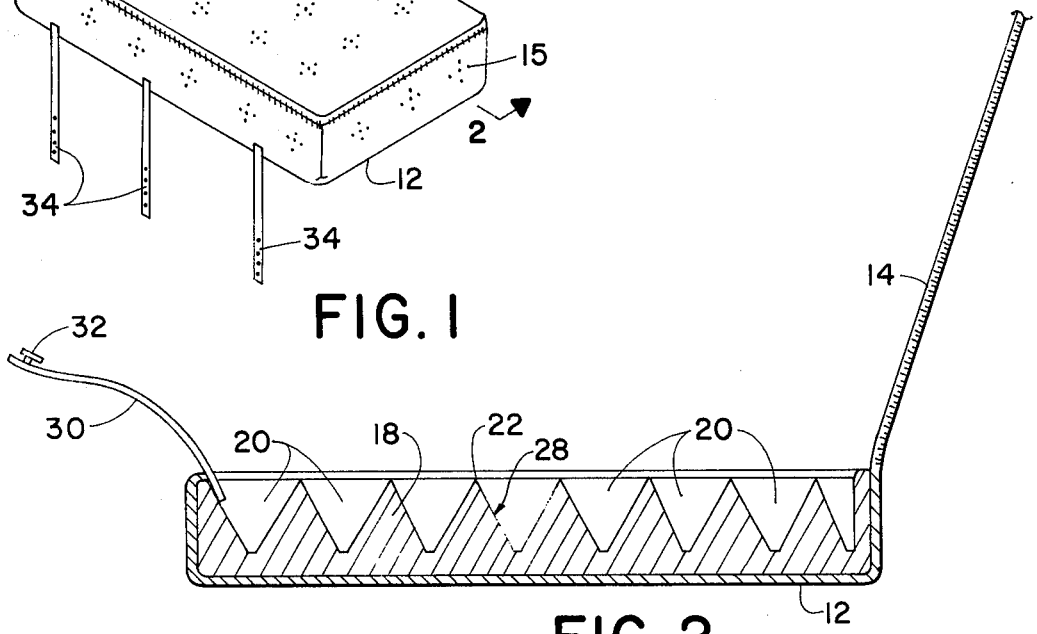
FIG. 2
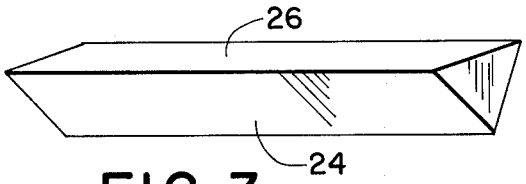
FIG. 3
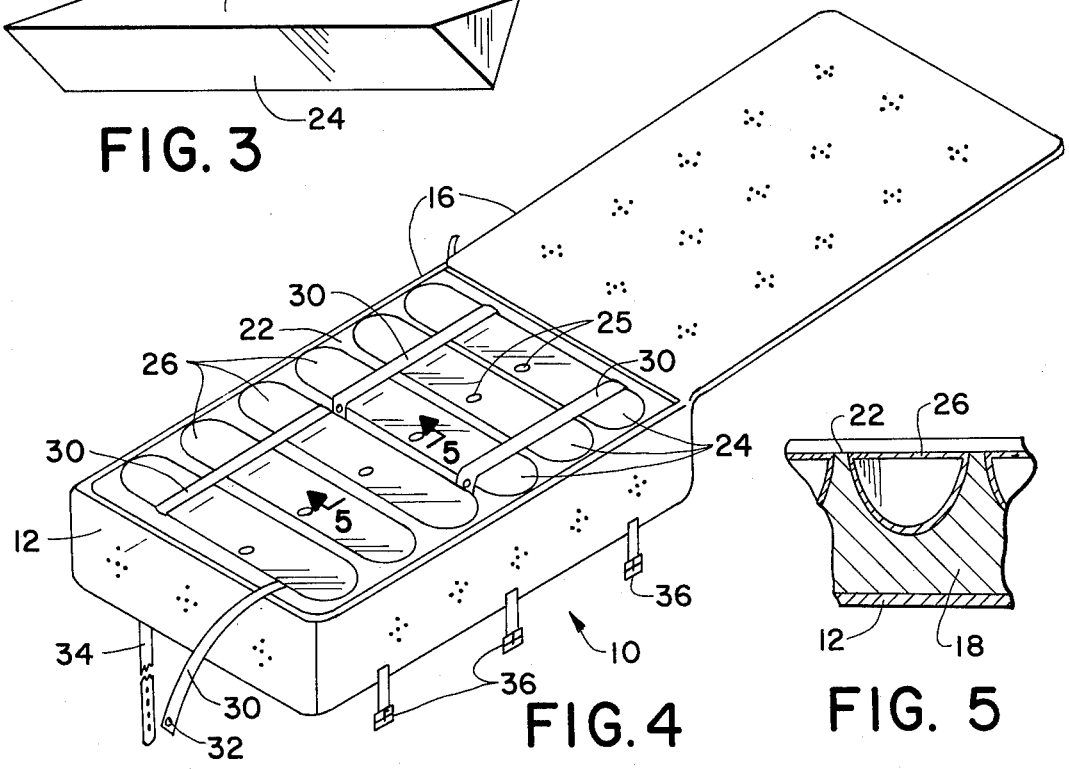
FIG. 4
FIG. 5

AIR MATTRESS

BACKGROUND OF THE INVENTION

The present invention relates to an air mattress construction.

Air matresses are known in the prior art having air tubes therein, but these tubes are part of the inner walls of the mattress and are thus fixed thereto and therefor have the disadvantage of not being removable.

Among the known prior art air matresses having the above and similar disadvantages are those disclosed in U.S. Pat. Nos. 1,282,980; 1,985,432; 2,542,781; 2,604,641; 3,128,480; 3,605,145; 3,705,429 and 3,780,388.

SUMMARY OF THE INVENTION

The principal object of the present invention is to provide an air mattress that has replacable air tubes or sacks.

A further object is to provide a mattress that will fit on a standard box spring to be set in a standard sized bed.

These and other objects are achieved by the present invention in which a foam rubber support member is configured to fit into a mattress enclosure shell. The enclosure includes the bottom and four sides of the shell with a planar top portion hinged at one end and closed by a zipper running around the edge of the top opening of the enclosure.

The support member has a plurality of contoured elongated width-wise grooves or pockets formed therein. Inflatable air tubes, configured to match the contour of the pocket (when inflated) are inserted therein and when assembled a flat surface is provided across the top of the enclosure. This comes about because the top of each tube is planar and aligns with top of the enclosure surface between the pockets.

Snap fasteners are utilized to retain the tubes in the enclosure and straps and cooperating buckle members are used to hold the assembled mattress to the bed spring.

Having in mind the above and other objects that will be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawings.

BRIEF DESCRIPTION OF THE DRAWING

The invention will be described in detail, by way of example, with reference to the accompanying drawing, in which:

FIG. 1 is a pictorial view of the preferred embodiment;

FIG. 2 is a sectional view taken along line 2—2 in FIG. 1 with the top opened;

FIG. 3 is a pictorial view of an air tube;

FIG. 4 is a pictorial view of the preferred embodiment; and

FIG. 5 is a partial sectional view taken along line 5—5 in FIG. 4.

DETAILED DESCRIPTION OF THE PREFERRED EMBODIMENT

Referring to FIGS. 1–5 of the drawing and in accordance with the principles of the present invention, an air mattress 10 is shown comprising an enclosure 12 and a flat top portion 14. Air holes 15 are provided in the enclosure 12 and the top to permit proper "breathing" of the mattress 10. The top portion 14 can be releasably opened and closed using a zipper 16 affixed around the periphery of top of the mattress enclosure 12. A resilient foam rubber support member 18 having a plurality of elongated width-wise grooves 20 is inserted in the enclosure 12 with its top surface 22 aligned with the top of the enclosure 12. Each groove 20 is configured to receive one inflatable air tube 24. When inflated through an air valve 25, disposed therein, the tube 24 forms one planar surface 26 that aligns with the plane of the mattress 10 when disposed in a groove 20. The tubes 24 may be prism shaped as shown in FIG. 2 or semi-cylindrical as shown in FIG. 5. The grooves 20 are configured to have a matching contour.

The air tubes 24 are retained in portion in the support member 18 by at least two first fastening elements 28 attached to the support member 18 and an equal number of straps 30 long enough to span across several air tubes 24 and affixed at one end to the support member 18 and having a second fastening element 32 affixed to the other end of the strap 30 and releasably engageable with the first fastening element 28. The first and second elements 28, 32 may comprise snap fasteners.

The air matress 10 can be mounted to a box spring, not shown, using a plurality of second straps 34 disposed on one side of the mattress enclosure 12 and engageable with a like number of buckle members 36 disposed on an opposite side of the enclosure 12.

While preferred embodiments of the invention have been shown and illustrated, it will be understood that the invention is in no way limited to these embodiments

What is claimed is:

1. An air mattress construction comprising:
   a. a hollow mattress enclosure including a planar top and means for releasably opening and closing same;
   b. a plurality of elongated inflatable air tubes each having a first planar surface when inflated; and
   c. a resilient support member insertable in said mattress enclosure and having the upper surface thereof corresponding to the top of the mattress and including means defining a plurality of elongated widthwise grooves therein each receptive of one air tube to position the first planar surface thereof in the plane of the top of the mattress and means for releasably retaining the air tubes in their positions in the support member.

2. A construction according to claim 1, wherein said means for releasably opening and closing comprises a zipper around the periphery of the top of the mattress.

3. A construction according to claim 2, wherein said support member comprises foam rubber.

4. A construction according to claim 3, wherein said means for releasably retaining comprises at least one pair of first fastening elements connected to the support member, at least one pair of straps each fixedly connected at one end to the support member and having a second fastening element at the other end and each disposable around a plurality of air tubes to engage the second fastening elements with the first fastening elements.

5. A construction according to claim 4, wherein the first and second fastening elements comprises snap fasteners.

6. A construction according to claim 5, further comprising means for mounting the mattress enclosure to a box spring comrising a plurality of buckles connected at one side of the mattress enclosure along the length thereof, and a plurality of straps connected to the opposite side of the mattress and each disposable around the box spring to engage with one buckle.

7. A construction according to claim 6, wherein each air tube and each groove is prism shaped.

8. A construction according to claim 6, wherein each air tube and each groove is semi-cylindrical in shape.

* * * * *